US011749470B2

(12) United States Patent
Wang et al.

(10) Patent No.: US 11,749,470 B2
(45) Date of Patent: Sep. 5, 2023

(54) SWITCHING COMPONENT COMPRISING INTEGRATED MOVEABLE CARRIER ASSEMBLIES

(71) Applicant: HONEYWELL INTERNATIONAL INC., Charlotte, NC (US)

(72) Inventors: Houyong Wang, Charlotte, NC (US); Yin Wei, Charlotte, NC (US); Fan Yang, Charlotte, NC (US); Jie Rao, Charlotte, NC (US); Yu Hu, Charlotte, NC (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 0 days.

(21) Appl. No.: 17/451,978

(22) Filed: Oct. 22, 2021

(65) Prior Publication Data

US 2023/0017700 A1 Jan. 19, 2023

(30) Foreign Application Priority Data

Jul. 15, 2021 (CN) ..... 202110800290.8

(51) Int. Cl.
*H01H 1/20* (2006.01)
*H01H 1/26* (2006.01)

(52) U.S. Cl.
CPC ..... *H01H 1/2025* (2013.01); *H01H 1/26* (2013.01)

(58) Field of Classification Search
CPC .... H01H 33/04; H01H 36/00; H01H 36/0006; H01H 1/00; H01H 1/12; H01H 1/2025;
(Continued)

(56) References Cited

U.S. PATENT DOCUMENTS 2,598,856 A * 6/1952 Swan ..... H01H 13/365 74/100.1
4,689,451 A * 8/1987 Resh ..... H01H 1/18 200/DIG. 42

(Continued)

FOREIGN PATENT DOCUMENTS

DE 4117120 A1 11/1992
EP 0162952 A1 12/1985
EP 3016125 A2 5/2016

OTHER PUBLICATIONS

European search report dated May 12, 2022 for EP Application No. 21205160.1.

*Primary Examiner* — Anthony R Jimenez
(74) *Attorney, Agent, or Firm* — Alston & Bird LLP

(57) ABSTRACT

Methods, apparatuses and systems for providing a switching component are disclosed herein. An example switching component may comprise: a housing; a moveable carrier a moveable carrier disposed within the housing; at least one integrated moveable contact assembly, the moveable contact assembly comprising a substrate, a set of moveable contacts disposed on a first surface of the substrate and a guiding element surrounding at least a portion of the substrate, wherein at least a portion of the guiding element is configured to abut a surface of the moveable carrier; and a set of stationary contacts adjacent the set of moveable contacts, wherein the set of moveable contacts is configured to move with two degrees of freedom to make contact with the set of stationary contacts in order to actuate an electrical bridge in response to movement of the moveable carrier.

19 Claims, 5 Drawing Sheets

(58) Field of Classification Search
CPC .. H01H 1/22; H01H 3/00; H01H 3/02; H01H 3/04; H01H 3/12; H01H 13/00; H01H 13/20; H01H 13/26; H01H 13/28; H01H 13/36; H01H 13/50; H01H 13/52; H01H 2003/00; H01H 2003/008; H01H 2003/02; H01H 5/02; H01H 5/18; H01H 5/22; H01H 36/0033; H01H 36/004; H01H 36/0046; H01H 36/0073; H01H 3/122; H01H 1/18; H01H 1/20; H01H 1/36; H01H 1/26; H01H 13/22; H01H 2001/12; H01H 2001/14; H01H 2001/22; H01H 5/00; H01H 5/04; H01H 5/06; H01H 5/08; H01H 5/10; H01H 5/14; H01H 5/20; H01H 5/26; H03K 17/962; G05B 2219/25439; G05B 2219/2642; G05B 15/02
USPC ..... 200/243, 242, DIG. 42
See application file for complete search history.

(56) References Cited

U.S. PATENT DOCUMENTS

| | | | | |
|---|---|---|---|---|
| 5,283,406 | A | 2/1994 | Olsen | |
| 5,510,584 | A * | 4/1996 | Norris | H01H 13/807 200/1 B |
| 9,099,263 | B2 | 8/2015 | Orrico | |
| 9,373,471 | B2 | 6/2016 | Goldman et al. | |

* cited by examiner

SWITCHING COMPONENT COMPRISING INTEGRATED MOVEABLE CARRIER ASSEMBLIES

CROSS-REFERENCE TO RELATED APPLICATIONS

This application claims priority pursuant to 35 U.S.C. 119(a) to China Patent Application No. 202110800290.8, filed Jul. 15, 2021, which application is incorporated herein by reference in its entirety.

BACKGROUND

Switching components comprising moveable carriers and moveable contacts may be used in conjunction with a variety of electrical devices, circuits and systems. An example moveable contact may be attached to a moveable carrier such that it can move to make contact with a stationary contact in order to actuate an electrical bridge/terminal. Such switching components are plagued by technical challenges and limitations. Through applied effort, ingenuity, and innovation, many of these identified problems have been solved by developing solutions that are included in embodiments of the present disclosure, many examples of which are described in detail herein.

BRIEF SUMMARY

Various embodiments described herein relate to methods, apparatuses, and systems for providing a switching component.

In accordance with various examples of the present disclosure, a switching component is provided. The switching component may comprise: a housing; a moveable carrier disposed within the housing; at least one integrated moveable contact assembly, the moveable contact assembly comprising a substrate, a set of moveable contacts disposed on a first surface of the substrate and a guiding element surrounding at least a portion of the substrate, wherein at least a portion of the guiding element is configured to abut a surface of the moveable carrier; and a set of stationary contacts adjacent the set of moveable contacts, wherein the set of moveable contacts is configured to move with two degrees of freedom to make contact with the set of stationary contacts in order to actuate an electrical bridge in response to movement of the moveable carrier.

In accordance with various examples of the present disclosure, another switching component is provided. The switching component may comprise: a housing; a moveable carrier disposed within the housing; a first integrated moveable contact assembly, a second integrated moveable contact assembly, a third integrated moveable contact assembly and a fourth integrated moveable contact assembly, wherein each integrated moveable contact assembly comprises a substrate, a set of moveable contacts disposed on a first surface of the substrate and a guiding element surrounding at least a portion of the substrate, and wherein at least a portion of the guiding element is configured to abut a surface of the moveable carrier; and a set of stationary contacts adjacent each respective set of moveable contacts of the first integrated moveable contact assembly, the second integrated moveable contact assembly, the third integrated moveable contact assembly and the fourth integrated moveable contact assembly, wherein each set of moveable contacts is configured to move with two degrees of freedom to make contact with a respective set of stationary contacts in order to actuate an electrical bridge in response to movement of the moveable carrier.

The foregoing illustrative summary, as well as other exemplary objectives and/or advantages of the disclosure, and the manner in which the same are accomplished, are further explained in the following detailed description and its accompanying drawings.

BRIEF DESCRIPTION OF THE DRAWINGS

The description of the illustrative embodiments may be read in conjunction with the accompanying figures. It will be appreciated that, for simplicity and clarity of illustration, elements illustrated in the figures have not necessarily been drawn to scale, unless described otherwise. For example, the dimensions of some of the elements may be exaggerated relative to other elements, unless described otherwise. Embodiments incorporating teachings of the present disclosure are shown and described with respect to the figures presented herein, in which.

DETAILED DESCRIPTION OF THE INVENTION

Figure 1:
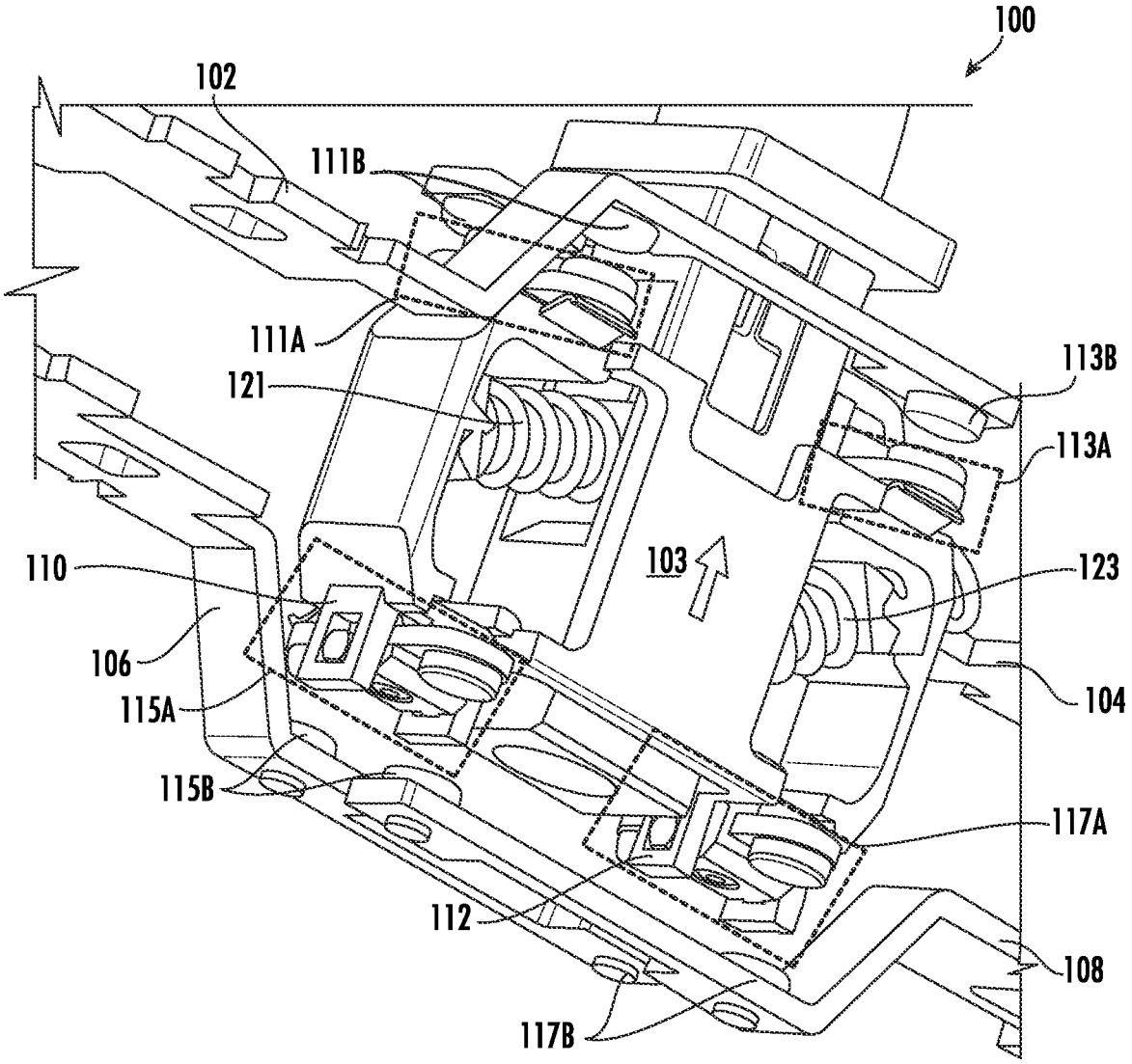
FIG. 1 illustrates an example switching component in accordance with various embodiments of the present disclosure.

Some embodiments of the present disclosure will now be described more fully hereinafter with reference to the accompanying drawings, in which some, but not all embodiments of the disclosure are shown. Indeed, these disclosures may be embodied in many different forms and should not be construed as limited to the embodiments set forth herein; rather, these embodiments are provided so that this disclosure will satisfy applicable legal requirements. Like numbers refer to like elements throughout.

As used herein, terms such as "front," "rear," "top," etc. are used for explanatory purposes in the examples provided below to describe the relative position of certain components or portions of components. Furthermore, as would be evident to one of ordinary skill in the art in light of the present disclosure, the terms "substantially" and "approximately" indicate that the referenced element or associated description is accurate to within applicable engineering tolerances.

The components illustrated in the figures represent components that may or may not be present in various embodiments of the present disclosure described herein such that embodiments may include fewer or more components than those shown in the figures while not departing from the scope of the present disclosure. Some components may be omitted from one or more figures or shown in dashed line for visibility of the underlying components.

The phrases "in an example embodiment," "some embodiments," "various embodiments," and the like generally mean that the particular feature, structure, or characteristic following the phrase may be included in at least one embodiment of the present disclosure, and may be included in more than one embodiment of the present disclosure (importantly, such phrases do not necessarily refer to the same embodiment).

The word "example" or "exemplary" is used herein to mean "serving as an example, instance, or illustration." Any implementation described herein as "exemplary" is not necessarily to be construed as preferred or advantageous over other implementations.

If the specification states a component or feature "may," "can," "could," "should," "would," "preferably," "possibly," "typically," "optionally," "for example," "often," or "might" (or other such language) be included or have a characteristic, that a specific component or feature is not required to be included or to have the characteristic. Such components or features may be optionally included in some embodiments, or may be excluded.

The terms "electronically coupled" or "in electronic communication with" in the present disclosure refer to two or more electrical elements (for example, but not limited to, an example processing circuitry, communication module, input/output module, memory, switching component) and/or electric circuit(s) being connected through wired means (for example but not limited to, conductive wires or traces) and/or wireless means (for example but not limited to, wireless network, electromagnetic field), such that electronic indications, signal or the like data and/or information (for example, electronic indications, signals) may be transmitted to and/or received from the electrical elements and/or electric circuit(s) that are electronically coupled.

The term "switching component" may refer to an electrical component, limit switch or electromechanical device that can be configured to connect or disconnect a conducting path in an electrical circuit such that electrical current flowing along the conducting path is interrupted or diverted. Switching components may be used in a variety of applications to control electrical circuits. Switching components may comprise one or more moveable contacts and one or more stationary contacts. In various applications, when a moveable contact and corresponding/adjacent stationary contact are in a closed state (i.e., make contact with one another), an electrical terminal/bridge is actuated such that electrical current can pass between them. In contrast, when a moveable contact and corresponding/adjacent stationary contact are in an open state (i.e., not in contact with one another), no electrical current passes between them.

In various examples, a moveable contact may be configured to move (e.g., wobble, rotate, swing) relative to a corresponding/adjacent stationary contact such that an electrical connection can be formed between them. An example switching component may comprise one or more moveable contacts attached to a moveable contact carrier such that the moveable contact(s) can move (e.g., up-and-down with respect to a corresponding/adjacent stationary contact(s)) in order to form an electrical connection with the corresponding/adjacent stationary contact(s).

In some examples, misalignment between a moveable contact and a corresponding/adjacent stationary contact may result in electrical arching or a failure to form a proper electrical connection between the moveable contact and the stationary contact. Accordingly, a switching component may comprise a set of moveable contacts comprising more than one moveable contact in order to provide design redundancy. For example, a set of moveable contacts comprising two moveable contacts may be positioned adjacent a set of stationary contacts comprising two corresponding/adjacent moveable contacts such that each respective pair of moveable contacts makes contact in order to actuate an electrical terminal/bridge.

In general, a switching component comprising more than one moveable contact may be fabricated with a gap between a body or structure of the moveable contact and the moveable carrier to which it is attached/secured such that the moveable contact and moveable contacts disposed thereon are able to move with a degree of freedom relative to corresponding/adjacent stationary contacts in order to form an electrical connection. However, in such examples, the presence of a gap between the body/structure of the moveable contact and the moveable carrier (e.g., between a surface of the moveable contact and an adjacent surface of the moveable carrier) may result in improper functioning under the influence of gravity. For example, if a moveable contact is not oriented in an upright position within a system, the moveable contact and corresponding/adjacent stationary contact may fail to make a proper electrical connection during operations and over the course of the electrical service life of the switching component. Additionally, existing switching components may be expensive to produce and difficult to fabricate due at least in part to the required gap between the body/structure of the moveable contact and the moveable carrier.

In accordance with various embodiments of the present disclosure, example methods, apparatuses and systems are provided. In various embodiments, the present disclosure may provide a switching component comprising a housing, a moveable carrier disposed within the housing, at least one integrated moveable contact assembly, the moveable contact assembly comprising a substrate, a set of moveable contacts disposed on a first surface of the substrate and a guiding element surrounding at least a portion of the substrate, wherein at least a portion of the guiding element is configured to abut a surface of the moveable carrier, and a set of stationary contacts adjacent the set of moveable contacts, wherein the set of moveable contacts is configured to move with two degrees of freedom to make contact with the set of stationary contacts in order to actuate an electrical bridge in response to movement of the moveable carrier. In some examples, the at least one integrated moveable contact assembly may further comprise a blade spring element disposed adjacent a second surface of the substrate configured to deform in response to movement of the integrated moveable contact assembly. In some examples, the blade spring element comprises an arch, ladder or bridge shape. In some examples, a first side of the blade spring element is fixedly attached to a first side of the substrate and a second side of the substrate is fixedly attached to a second side of the substrate defining a gap therebeneath. In some examples, the integrated moveable contact assembly is attached to the moveable carrier via a securing element. In some examples, the guiding element comprises at least one appendage configured to abut an aperture of the securing element. In some examples, the guiding element comprises a first appendage configured to abut a first aperture of the securing element and a second appendage configured to abut a second aperture of the securing element. In some examples, the substrate, the guiding element and the blade spring element are fixedly attached to one another via a securing pin. In some examples, the set of stationary contacts comprises a first moveable contact and a second moveable contact, and the set of moveable contacts comprises a third moveable contact adjacent the first moveable contact and a fourth moveable contact adjacent the second moveable contact. In some examples, the set of stationary contacts is fixedly attached to at least one bridge element of the switching component.

Using the apparatuses and techniques disclosed herein, the electrical service life of an example switching component can be increased, in some examples, from 500,000 operations to, in some examples, over 1,500,000. Additionally, the example switching component will function optimally when configured in any position within a system and will not be affected by gravity. By way of example, a switching component with one or more integrated moveable contact assemblies may provide two degrees of freedom of movement. For example, moveable contacts may move (e.g., wobble, rotate or the like) in both a lateral direction and up-and-down which greatly increases reliability and longevity of the switching component. Additionally, by utilizing integrated moveable contact assemblies, motion of the moveable contacts in relation to the stationary contacts will not be affected by any conceivable orientation of the switching component. Further, the example switching component of the present disclosure is less complex and inexpensive to produce in comparison to existing devices.

Referring now to FIG. 1, an example schematic diagram depicts an example switching component 100 in accordance with various embodiments of the present disclosure. In particular, the example switching component 100 comprises a moveable carrier 103, a first integrated moveable contact assembly 111A and corresponding/adjacent stationary contacts 111B, a second integrated moveable contact assembly 113A and corresponding/adjacent stationary contacts 113B, a third integrated moveable contact assembly 115A and corresponding/adjacent stationary contacts 115B, a fourth integrated moveable contact assembly 117A and corresponding/adjacent stationary contacts 117B, a first bridge element 102, a second bridge element 104, a third bridge element 106, a fourth bridge element 108, a first securing element 110 and a second securing element 112. The example switching component 100 may be arranged, contained and/or at least partially disposed within a housing/body (e.g., comprising metal, plastic, combinations thereof, and/or the like). The example switching component 100 may be a component of an electrical system and/or in wired communication with other electrical components and/or devices.

In some examples, the first integrated moveable contact assembly 111A and corresponding/adjacent stationary contacts 111B, the second integrated moveable contact assembly 113A and corresponding/adjacent stationary contacts 113B, the third integrated moveable contact assembly 115A and corresponding/adjacent stationary contacts 115B and the fourth integrated moveable contact assembly 117A and corresponding/adjacent stationary contacts 117B may be at least partially disposed within a housing of the switching component 100. As further described herein with reference to FIG. 3 and FIG. 4, each integrated moveable contact assembly 111A, 113A, 115A and 117A comprises a pair of moveable contacts/pads disposed on a substrate, a guiding element and a blade spring element.

As depicted in FIG. 1, the example switching component 100 comprises a moveable carrier 103 configured to move within an example housing/body such that one or more sets of moveable contacts/integrated moveable assemblies and stationary contacts make contact in order to actuate an electrical terminal/bridge associated therewith. In some examples, the moveable carrier 103 may comprise an insulating material such as plastic. In various embodiments, the moveable carrier 103 may comprise a moveable armature and one or more springs to facilitate movement of the moveable carrier 103. As illustrated in FIG. 1, the switching component 100 comprises a first spring 121 and a second spring 123 disposed adjacent the moveable carrier that operate to facilitate movement thereof. For example, the moveable carrier 103 may be configured to move vertically within the housing of the switching component 100. Additionally, as depicted, the first spring 121 and the second spring 123 are oriented diagonally in relation to the moveable carrier 103. In various embodiments, the first spring 121 and the second spring 123 operate to provide contact force to facilitate contact and actuation of an electrical terminal/bridge between the integrated moveable contact assemblies 111A, 113A, 115A and 117A and corresponding/adjacent stationary contacts 111B, 113B, 115B and 117B.

The moveable carrier 103 may be configured to move vertically within the housing of the switching component 100 (e.g., in ay-direction) such that the first integrated moveable contact assembly 111A and the second integrated moveable contact assembly 113A disposed on a top portion of the moveable carrier 103 make contact with respective stationary contacts 111B and 113B in order to actuate an electrical terminal/bridge (e.g., the first bridge element 102 and the second bridge element 104). The moveable carrier 103 may be configured to move within the housing of the switching component 100 (e.g., in the y-direction) such that the third integrated moveable contact assembly 115A and the fourth integrated moveable contact assembly 117A disposed on a bottom portion of the moveable carrier 103 make contact with respective stationary contacts 115B and 117B in order to actuate an electrical terminal/bridge (e.g., the third bridge element 106 and the fourth bridge element 108).

As depicted in FIG. 1, the third integrated moveable contact assembly 115A is attached to a bottom portion of the of the moveable carrier 103 via a first securing element 110 and the fourth integrated moveable contact assembly 117A is attached to a bottom portion of the moveable carrier 103 via a second securing element 112. As depicted, the first securing element 110 and the second securing element 112 each comprise one or more apertures through which at least a portion of the moveable contact assemblies 115A and 117A can be attached to the moveable carrier 103. Similarly, the first integrated moveable contact assembly 111A and the second integrated moveable contact assembly 113A may be attached to a top portion of the moveable carrier 103 via respective securing elements associated therewith.

As noted above, each integrated moveable contact assembly 111A, 113A, 115A and 117A may be positioned adjacent a respective set of stationary contacts 111B, 113B, 115B and 117B. As depicted in FIG. 1, each set of respective stationary contacts 111B, 113B, 115B and 117B may be fixedly attached to a surface of the switching component 100 (e.g., attached to a surface of a bridge element associated therewith). As depicted, each integrated moveable contact assembly 111A, 113A, 115A and 117A and each stationary contacts 111B, 113B, 115B and 117B comprises a pair of contact pads.

As noted above, the switching component 100 comprises a first bridge element 102, a second bridge element 104, a third bridge element 106 and a fourth bridge element 108. In some examples, each bridge element 102, 104, 106 and 108 may be or comprise a substantially planar conductive metal substrate. For example, each bridge element 102, 104, 106 and 108 may comprise, silver, nickel, copper, cadmium oxide, tin oxide, combinations thereof, and/or the like. Each bridge element 102, 104, 106 and 108 may be in wired communication with/electrically connected to other elements, components and/or devices within an electrical circuit/system.

As depicted in FIG. 1, the first set of stationary contacts 111B is fixedly attached to the first bridge element 102 and a second bridge element 104 of the switching component 100, respectively. Similarly, the second set of stationary contacts 113B is fixedly attached to the first bridge element 202 of the switching component 100. As shown, the third set of stationary contacts 115B is fixedly attached to the third bridge element 106 and the fourth bridge element 108 of the switching component 100. Similarly, the fourth set of stationary contacts 117B is fixedly attached to the third bridge element 106 and the fourth bridge element 108 of the switching component 100.

While some of the embodiments herein provide an example switching component 100, it is noted that the scope of the present disclosure is not limited to such embodiments. For example, a switching component 100 in accordance with the present disclosure may be in other forms. In some examples, an example switching component 100 may comprise one or more additional and/or alternative elements, and/or may be structured/positioned differently than that illustrated in FIG. 1.

As depicted, the switching component 200 comprises a first integrated moveable contact assembly 211A and corresponding/adjacent stationary contacts 211B, a second integrated moveable contact assembly 213A and corresponding/adjacent stationary contacts 213B, a third integrated moveable contact assembly 215A and corresponding/adjacent stationary contacts 215B, a fourth integrated moveable contact assembly 217A and corresponding/adjacent stationary contacts 217B, a first bridge element 202, a second bridge element 204, a third bridge element 206, a fourth bridge element 208, a first securing element 203, a second securing element 205, a third securing element 207 and a fourth securing element 209. The example switching component 200 may be at least partially disposed within a housing 225 of an example switching component.

Figure 2:
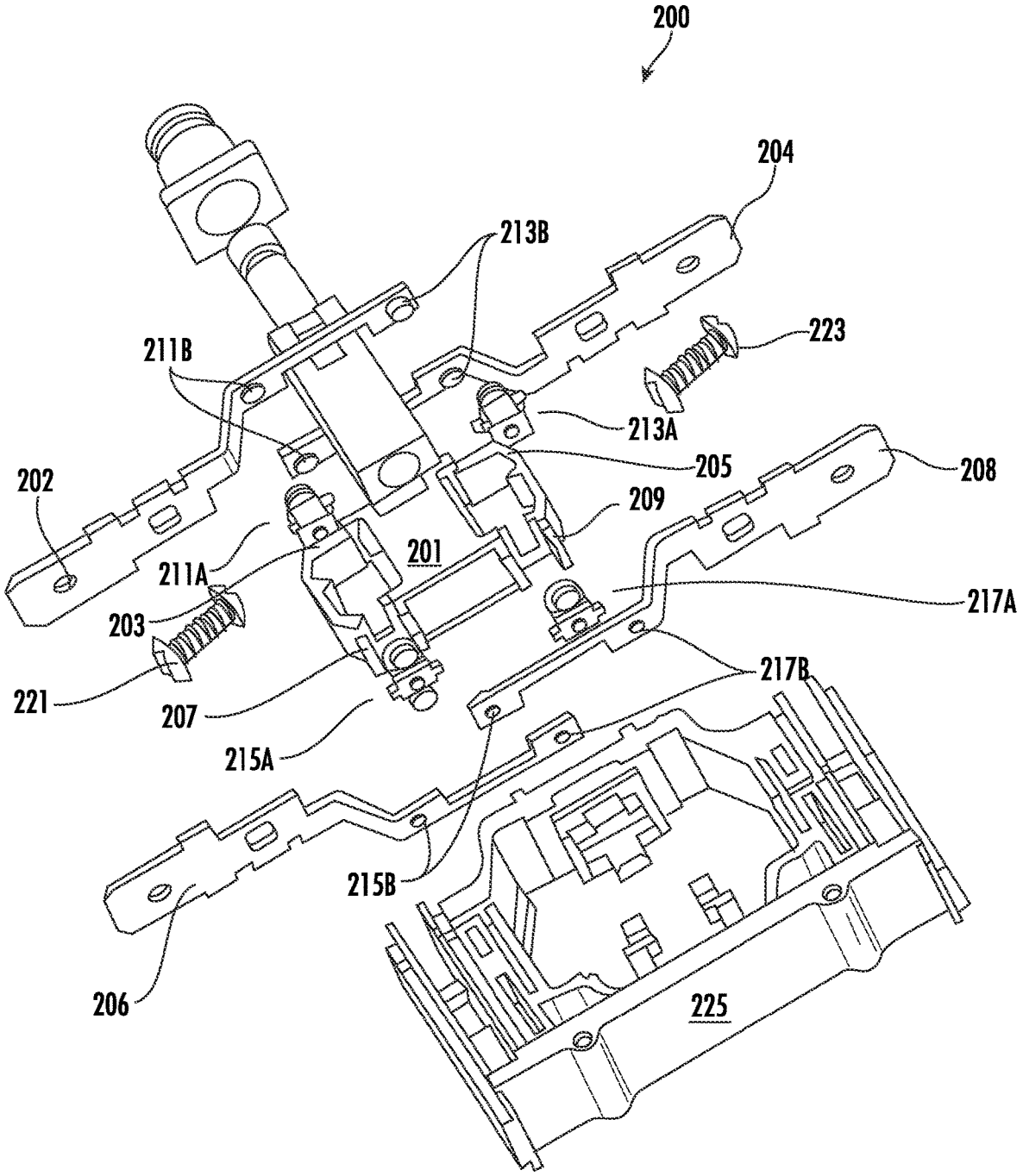
FIG. 2 illustrates an example switching component in accordance with various embodiments of the present disclosure.

As noted above in connection with FIG. 1, the moveable carrier 201 is configured to move vertically (e.g., in a y-direction) within a housing 225 of an example switching component 200. As depicted in FIG. 2, the moveable carrier 201 is configured to move within a housing such that the one or more integrated moveable contact assemblies 211A, 213A, 215A and 217A and corresponding/adjacent sets of stationary contacts 211B, 213B, 215B and 217B make contact in order to actuate an electrical terminal/bridge (e.g., the first bridge element 202, the second bridge element 204, the third bridge element 206 and/or the fourth bridge element 208).

As shown, the example switching component 200 comprises a first integrated moveable contact assembly 211A and a second integrated moveable contact assembly 213A, each disposed/attached to a top portion of the moveable carrier 201. Additionally, as depicted, the switching component 200 comprises a third integrated moveable contact assembly 215A and a fourth integrated moveable contact assembly 217A each disposed/attached to a bottom portion of the moveable carrier 201. As further detailed with reference to FIG. 3 and FIG. 4, and as depicted, each integrated moveable contact assembly 211A, 213A, 215A and 217A comprises a pair of moveable contacts/pads disposed on a substrate, a guiding element and a blade spring element.

The example switching component 200 further comprises a first set of stationary contacts 211B disposed adjacent to and positioned directly above the first integrated moveable contact assembly 211A. The example switching component 200 comprises a second set of stationary contacts 213B disposed adjacent to and positioned directly above the second integrated moveable contact assembly 213A. As shown, the example switching component 200 comprises a third set of stationary contacts 215B disposed adjacent to and directly below the third integrated moveable contact assembly 215A. Additionally, the example switching component 200 comprises a fourth set of stationary contacts 217B disposed adjacent to and directly below the fourth integrated moveable contact assembly 217A.

As noted above, the moveable carrier 201 is configured to move vertically within a housing (e.g., in ay-direction) such that the first integrated moveable contact assembly 211A and the second integrated moveable contact assembly 213A disposed on the top portion of the moveable carrier 201 make contact with respective stationary contacts 211B and 213B in order to actuate an electrical terminal/bridge (e.g., the first bridge element 202 and the second bridge element 204). The moveable carrier 201 is configured to move within the housing (e.g., in the y-direction) such that the third integrated moveable contact assembly 215A and the fourth integrated moveable contact assembly 217A disposed on the bottom portion of the moveable carrier 201 make contact with respective stationary contacts 215B and 217B in order to actuate an electrical terminal/bridge (e.g., the third bridge element 206 and the fourth bridge element 208). As further depicted in FIG. 2, the moveable carrier 201 is configured to be at least partially disposed within at least a portion of a housing 225 of the switching component 200. Additionally, as illustrated, the switching component 200 comprises a first spring 221 and a second spring 223 that are configured to be at least partially disposed within the housing 225 of the switching component 200 in order to facilitate movement of the moveable carrier 201. In some examples, as depicted, the first spring 221 and the second spring 223 may be disposed diagonally within the housing 225 of the switching component 200.

As depicted in FIG. 2, the first integrated moveable contact assembly 211A may be attached to a top portion of the moveable carrier 201 via a first securing element 203 of the moveable carrier 201. As further depicted, the second integrated moveable contact assembly 213A may be attached to a top portion of the moveable carrier 201 via a second securing element 205 of the moveable carrier 201. As shown, the third integrated moveable contact assembly 215A may be attached to a bottom portion of the of the moveable carrier 201 via a third securing element 207. Similarly, the fourth integrated moveable contact assembly 217A may be attached to a bottom portion of the moveable carrier 201 via a fourth securing element 209.

As noted above, each integrated moveable contact assembly 211A, 213A, 215A and 217A may be positioned adjacent a respective set of stationary contacts 211B, 213B, 215B and 217B. As depicted in FIG. 2, each set of respective stationary contacts 211B, 213B, 215B and 217B may be fixedly attached to a portion or component of the switching component 200/switching component. As depicted, each set of stationary contacts 211B, 213B, 215B and 217B comprises two distinct contacts, each attached to an element/component (e.g., bridge element) of the switching component 200. In some examples, each set of stationary contacts 211B, 213B, 215B and 217B and/or the integrated moveable contact assembly 211A, 213A, 215A and 217A may each comprise more than two contact pads. For example, a set of stationary contacts and/or integrated moveable contact assembly may each comprise three moveable contacts. Each moveable contact may comprise a substantially circular conductive metal material. In various examples, an example contact pad of a set of stationary contacts 211B, 213B, 215B and 217B may be identical and/or similar to the contact pads of a corresponding/adjacent integrated moveable contact assembly 211A, 213A, 215A and 217A. A contact pad may comprise, for example, without limitation, silver, nickel, copper, cadmium oxide, tin oxide, combinations thereof, and/or the like.

As depicted in FIG. 2, the first set of stationary contacts 211B comprises a first stationary contact fixedly attached to the first bridge element 202 and a second stationary contact fixedly attached to the second bridge element 204 of the switching component 200. Similarly, the second set of stationary contacts 213B comprises a first stationary contact fixedly attached to the first bridge element 202 and a second stationary contact fixedly attached to the second bridge element 204 of the switching component 200. As shown, the third set of stationary contacts 215B comprises a first stationary contact fixedly attached to the third bridge element 206 and a second stationary contact fixedly attached to the fourth bridge element 208 of the switching component 200. Similarly, the fourth set of stationary contacts 217B comprises a first stationary contact fixedly attached to the third bridge element 206 and a second stationary contact fixedly attached to the fourth bridge element 208 of the switching component 200. As noted above, each of the first bridge element 202, second bridge element 204, third bridge element 206 and fourth bridge element 208 may be or comprise a substantially planar conductive metal substrate in wired communication with/electrically connected to other elements, components and/or devices within an electrical circuit/system.

While some of the embodiments herein provide an example switching component 200, it is noted that the scope of the present disclosure is not limited to such embodiments. For example, in some examples, a switching component 200 in accordance with the present disclosure may be in other forms. In some examples, a switching component 200 may comprise one or more additional and/or alternative elements, and/or may be structured/positioned differently than that illustrated in FIG. 2.

Figure 3:
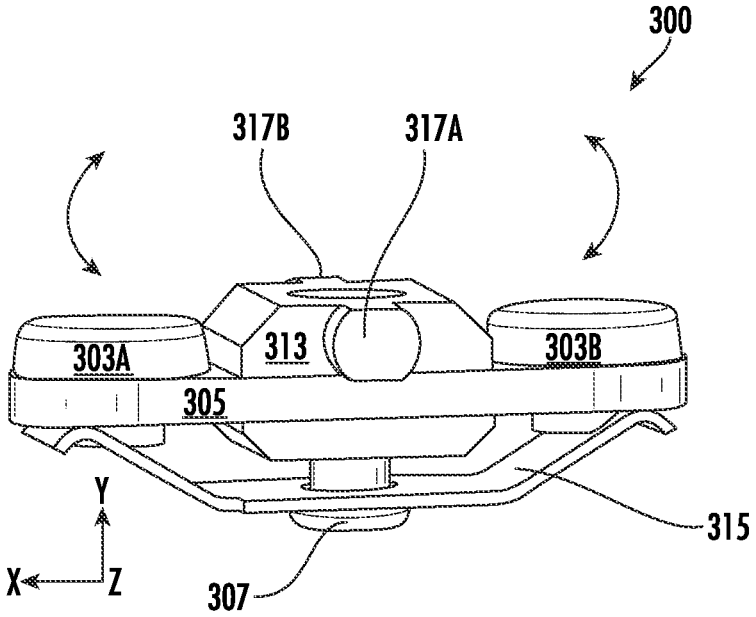
FIG. 3 illustrates an example integrated moveable contact assembly in accordance with various embodiments of the present disclosure.

Referring now to FIG. 3, an example schematic diagram depicting an example moveable contact assembly 300 in accordance with some embodiments of the present disclosure is provided.

As depicted in FIG. 3, the example moveable contact assembly 300 comprises a first moveable contact 303A and a second moveable contact 303B, a substrate 305, a blade spring element 315, a securing pin 307 and a guiding element 313.

As noted above, the moveable contact assembly 300 comprises a substrate 305. In various examples, as shown, the substrate 305 defines substantially planar elliptical body. The substrate 305 of the moveable contact assembly 300 may be or comprise a metallic material (e.g., copper, brass, and/or the like). As shown, a first moveable moveable contact 307A and a second moveable moveable contact 307B are disposed on a top surface of the substrate 305 and define a set of moveable contacts. As further depicted, the example first moveable contact 303A and second moveable contact 303B may be or comprise identical circular shaped pads. Each of the first moveable contact 303A and the second moveable contact 303B may comprise for example, without limitation, silver, nickel, copper, cadmium oxide, tin oxide, combinations thereof, and/or the like. As depicted in FIG. 3, the first moveable contact 303A is disposed on a first side of a top surface of the substrate 305 of the moveable contact assembly 300. The second moveable contact 303B is disposed on a second side of the top surface of the substrate 305, opposite the first moveable contact 303A. In various examples, the first moveable contact 303A and the second moveable contact 303B may be configured to move freely in an x-direction (e.g., laterally) and a y-direction (e.g., up and down) with respect to the moveable carrier/switching component housing.

As further depicted in FIG. 3, the moveable contact assembly 300 comprises a guiding element 313 which may operate to facilitate movement of the moveable contact assembly 300 with respect to a moveable carrier (e.g., in conjunction with a securing element). Additionally, as depicted, in some examples, the guiding element 313 comprises a first appendage 317A and a second appendage 317B configured to engage at least a portion of an example moveable carrier/securing element adjacent thereto. As depicted in FIG. 3, the first appendage 317A and the second appendage 317B comprise cylindrical features configured to abut at least a portion of a moveable carrier/securing element (e.g., one or more apertures of an example securing element). As further depicted, the guiding element 313 is disposed centrally with respect to the substrate 305 and surrounds at least a portion of the substrate 305. Additionally, the guiding element 313 is located between the first moveable contact 303A and the second moveable contact 303B. As shown, at least a portion of the the guiding element 313 may be in contact with a top surface and a bottom surface of the substrate 305. As depicted, the guiding element 413 comprises a substantially polygonal member and may comprise plastic or similar materials.

Additionally, as depicted in FIG. 3, the moveable contact assembly 300 comprises a blade spring element 315 disposed adjacent a bottom surface of the substrate 305. The blade spring element 315 may operate to facilitate lateral and/or vertical movement of the moveable contact assembly 300, and in particular the first moveable contact 303A and the second moveable contact 303B. In various examples, the blade spring element 315 may define an arch, ladder or bridge-shaped metallic element at least partially spaced apart from the bottom surface of the substrate 305. As depicted, the blade spring element 315 comprises a bridge-shaped element. As shown, at least a first end portion of the blade spring element 315 and at least a second portion of the blade spring element 315 may be fixedly attached or otherwise coupled to a bottom surface (e.g., as depicted, a first side and a second side) of the substrate 305. As further depicted, at least a portion of the blade spring element 315 is fixedly attached to or otherwise coupled to the guiding element 313 via a securing pin 307. In some examples, the blade spring element 315 is configured to compress approximately 0.5 mm in the y-direction relative to the bottom surface of the substrate 305.

While some of the embodiments herein provide an example moveable contact assembly 300, it is noted that the scope of the present disclosure is not limited to such embodiments. For example, in some examples, a moveable contact assembly 300 in accordance with the present disclosure may be in other forms. In some examples, a moveable contact assembly 300 may comprise one or more additional and/or alternative elements, and/or may be structured/positioned differently than that illustrated in FIG. 3.

Figure 4:
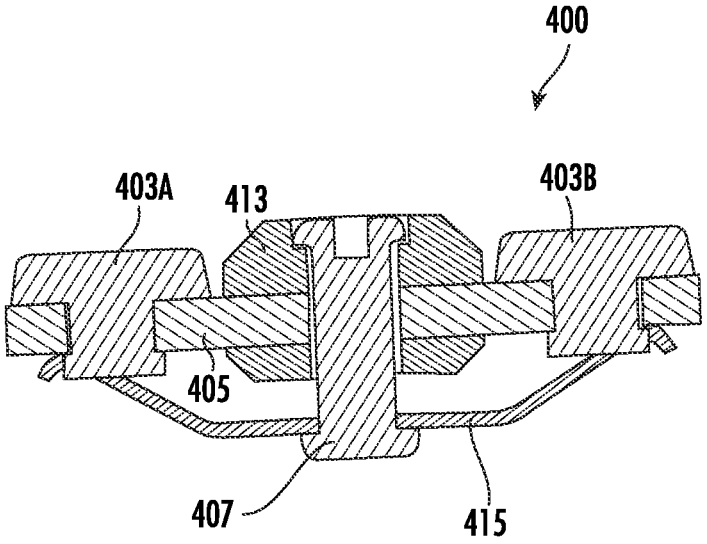
FIG. 4 illustrates an example integrated moveable contact assembly in accordance with various embodiments of the present disclosure.

Referring now to FIG. 4, an example schematic diagram depicting a side section view of a moveable contact assembly 400 in accordance with some embodiments of the present disclosure is provided.

As depicted in FIG. 4, the example moveable contact assembly 400 comprises a first moveable contact 403A and a second moveable contact 403B, a substrate 405, a blade spring element 415, a securing pin 407 and a guiding element 413.

As depicted in FIG. 4, the moveable contact assembly 400 comprises a substrate 405. In various examples, as shown, the substrate 405 defines substantially planar elliptical body. The substrate 405 of the moveable contact assembly 400 may be or comprise a metallic material. As shown, the first moveable moveable contact 403A and a second moveable moveable contact 403B are disposed on a top surface of the substrate 405 (defining a set of moveable contacts). As further depicted, the example first moveable contact 403A and second moveable contact 403B may be or comprise identical circular shaped pads. As depicted in FIG. 4, the first moveable contact 403A is disposed on a first side of a top surface of the substrate 405 of the moveable contact assembly 400. The second moveable contact 403B is disposed on a second side of the top surface of the substrate 405, opposite the first moveable contact 403A. In various examples, the first moveable contact 403A and the second moveable contact 403B may be configured to move freely in an x-direction (e.g., laterally) and y-direction (e.g., up-and-down) with respect to the moveable carrier/switching component housing.

As further depicted in FIG. 4, the moveable contact assembly 400 comprises a guiding element 413 which may operate to facilitate movement of the moveable contact assembly 400 with respect to a moveable carrier (e.g., in conjunction with a securing element). In various examples, the guiding element 413 may comprise a unitary body or more than one members that are attached and/or otherwise coupled to one another. At least a portion of the guiding element 413 may be configured to engage and/or abut at least a portion of an example moveable carrier/securing element adjacent thereto. As further depicted, the guiding element 413 is disposed centrally with respect to the substrate 405 and surrounds at least a portion of the substrate 405. Additionally, the guiding element 413 is disposed between the first moveable contact 403A and the second moveable contact 403B. As shown, at least a portion of the the guiding element 413 may be in contact with a top surface and a bottom surface of the substrate 405.

Additionally, as depicted in FIG. 4, the moveable contact assembly 400 comprises a blade spring element 415 disposed adjacent a bottom surface of the substrate 405. The blade spring element 415 may operate to facilitate lateral and/or vertical movement of the moveable contact assembly 400, and in particular the first moveable contact 403A and the second moveable contact 403B. In various examples, the blade spring element 415 may define an arch, ladder or bridge-shaped metallic element at least partially spaced apart from the bottom surface of the substrate 405. As depicted, the blade spring element 415 comprises a bridge-shaped element. As shown, at least a first end portion of the blade spring element 415 and at least a second portion of the blade spring element 415 may be fixedly attached or otherwise coupled to a bottom surface (e.g., as depicted, a first side and a second side) of the substrate 405. As further depicted, at least a portion of the blade spring element 415 is fixedly attached to or otherwise coupled to the guiding element 413 via a securing pin 407.

While some of the embodiments herein provide an example moveable contact assembly 400, it is noted that the scope of the present disclosure is not limited to such embodiments. For example, in some examples, a moveable contact assembly 400 in accordance with the present disclosure may be in other forms. In some examples, a moveable contact assembly 400 may comprise one or more additional and/or alternative elements, and/or may be structured/positioned differently than that illustrated in FIG. 4.

Figure 5:
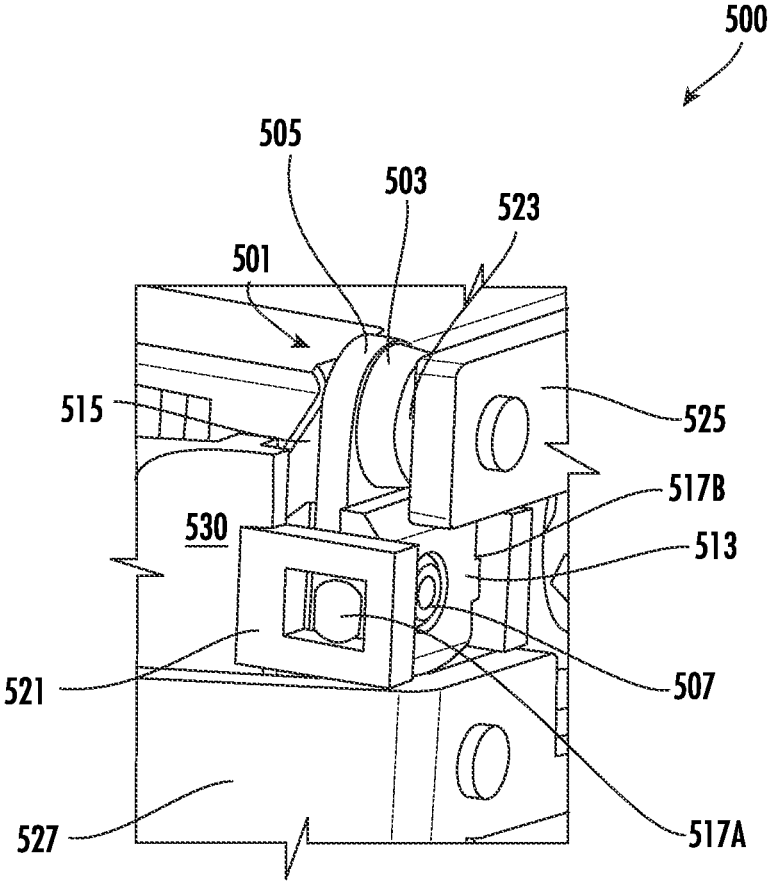
FIG. 5 illustrates an example portion of a switching component in accordance with various embodiments of the present disclosure.

Referring now to FIG. 5, an example portion of a switching component 500 in accordance with some embodiments of the present disclosure is provided.

As depicted in FIG. 5, the example portion of a switching component 500 comprises a moveable contact assembly 501 comprising a substrate 505, at least one moveable contact 503, a guiding element 513 and a blade spring element 515. The moveable contact assembly 501 may be similar or identical to the moveable contact assembly 400 described above in connection with FIG. 4. The moveable contact assembly 501 may be a portion of a switching component and, as depicted, may be operatively coupled to a moveable carrier 530.

As noted above, and as depicted in FIG. 5, the moveable contact assembly 501 comprises a substrate 505 defining a substantially planar elliptical body. As shown, at least a first moveable contact 503 is disposed on a first/top surface of the substrate 505. In various examples, two or more moveable contacts may be disposed on a first/top surface of the example substrate 505. Additionally, as depicted, the moveable contact assembly comprises a guiding element 513 which may operate to facilitate movement of the moveable contact assembly 501 in conjunction with a securing element 521 and with respect to the moveable carrier 530. At least a portion of the the guiding element 513 may be in contact with a first/top surface and a second/bottom surface of the substrate 505. Additionally, as illustrated, the guiding element 513 is disposed centrally (e.g., disposed between moveable contacts/pads of the moveable contact assembly 501) with respect to the substrate 505 of the moveable contact assembly 501 and surrounds at least a portion of the substrate 505.

As depicted in FIG. 5, the moveable contact assembly 501 comprises a blade spring element 515 disposed adjacent a bottom surface of the substrate 505. The blade spring element 515 may operate to facilitate lateral and/or vertical movement of the moveable contact assembly 501, and in particular the moveable contacts (e.g., moveable contact 503 and one or more additional moveable contacts disposed on a surface of the substrate 505). In various examples, the blade spring element 515 comprises an arch, ladder or bridge-shaped metallic element at least partially spaced apart from the bottom surface of the substrate 505. As shown, at least a first end portion of the blade spring element 515 and at least a second portion of the blade spring element 515 may be fixedly attached or otherwise coupled to a bottom surface (e.g., a first side and a second side) of the substrate 505. As further depicted, at least a portion of the blade spring element 515 is fixedly attached to or otherwise coupled to the guiding element 513 via a securing pin 507.

As noted above, and as further depicted in FIG. 5, the switching component 500 comprises a moveable carrier 530 and at least a securing element 521. The securing element 521 and the moveable carrier 530 may define a unitary body or be otherwise fixedly attached to one another. As depicted, at least a a portion of the guiding element 513 is configured to engage and/or abut at least a portion of the securing element 521. For example, as illustrated, a first appendage 517A and a second appendage 517B of the guiding element 513 are configured to engage apertures (e.g., slots, grooves, or the like) of the securing element 521. In some examples, a gap between the first appendage 517A and/or the second appendage 517B and an edge of the aperture of the securing element 521 may be between 0.1 mm and 0.5 mm thereby ensuring movement of the moveable contact assembly 501, and in particular, the guiding element 513 relative to the securing element 521 with a degree of freedom.

As depicted, the first appendage 517A is configured to engage a first aperture of the securing element 521 such that the moveable contact assembly can rotate (e.g., wobble, move and/or the like) about the axis of the first appendage 517A. In various examples, as depicted, the aperture(s) of the securing element 521 may be rectangular. In other examples, the aperture(s) of the securing element 521 may be circular, polygonal, or the like. Similarly, the second appendage 517B may be configured to engage a second aperture of the securing element 521. In various examples, the movement of the appendage 517A of the guiding element 513 may be at least partially facilitated by elasticity of the blade spring element 515 which allows the blade spring element 515 to deform in response to movement of the moveable carrier 530. In some examples, the blade spring element 515 may deform between 0.3 mm to 0.5 mm. In various examples, the moveable contacts (e.g., at least the moveable contact 503) of the moveable contact assembly are be configured to move freely in an x-direction (e.g., laterally) and y-direction (e.g., up and down) with respect to the moveable carrier 530/securing element 521 such that the moveable contacts can make contact with adjacent stationary contacts in order to actuate an electrical bridge. Said differently, the moveable contact assembly 501 can move with two degrees of freedom in relation to the moveable carrier 530/securing element 521. By way of example, as depicted, the moveable contact 503 may be configured to make contact with the stationary contact 523 attached to the first bridge element 525. Similarly, one or more stationary contacts 523 of the second bridge element 527 may be configured to make contact with adjacent moveable contact(s).

While some of the embodiments herein provide an example portion of a switching component 500, it is noted that the scope of the present disclosure is not limited to such embodiments. In some examples, a securing element 521 in accordance with the present disclosure may be in other forms. In some examples, a securing element 521 may comprise one or more additional and/or alternative elements, and/or may be structured/positioned differently than that illustrated in FIG. 5.

Figure 6:
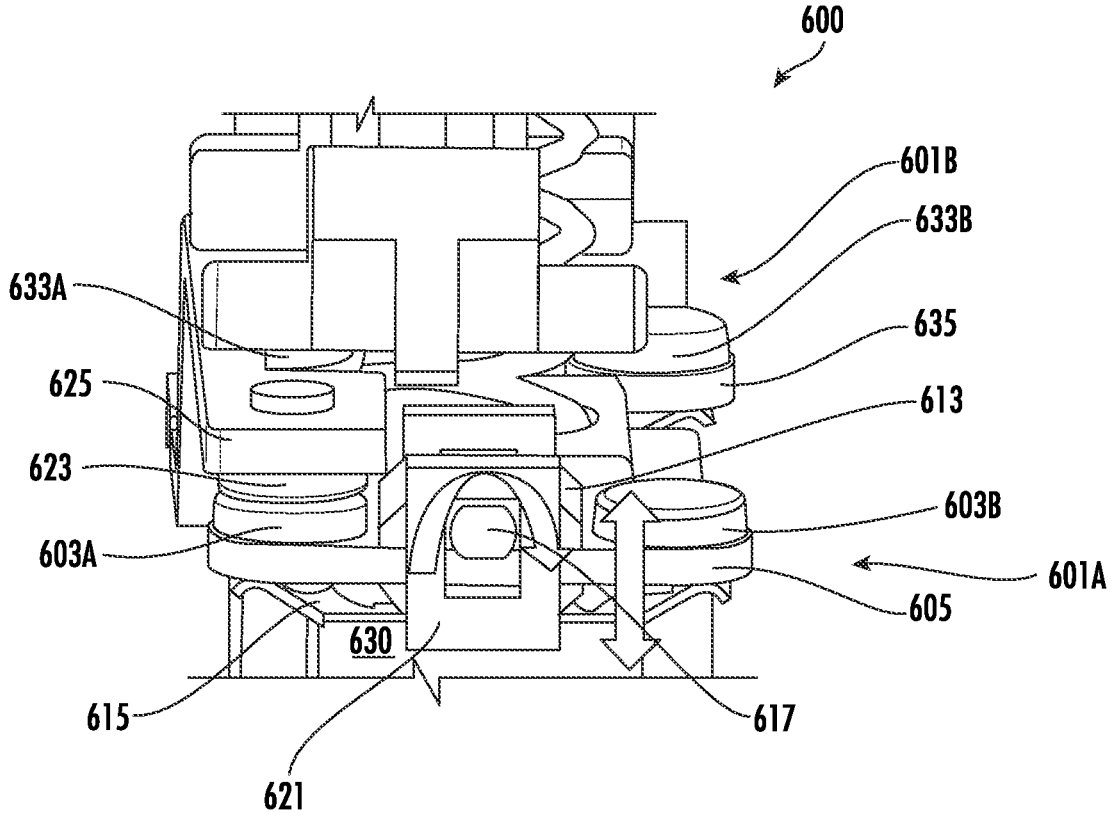
FIG. 6 illustrates an example portion of of a switching component in accordance with various embodiments of the present disclosure.

Referring now to FIG. 6, an example portion of a switching component 600 in accordance with some embodiments of the present disclosure is provided.

As depicted in FIG. 6, the example portion of a switching component 600 comprises a first moveable contact assembly 601A, a second moveable contact assembly 601B, a moveable carrier 630 and at least one securing element 621.

As further depicted in FIG. 6, the first moveable contact assembly 601A comprises a first substrate 625, a first moveable contact 603A, a second moveable contact 603B, a guiding element 613 and a blade spring element 615. Similarly, as depicted, the second moveable contact assembly 601B comprises a second substrate 635, a third moveable contact 633A, a fourth moveable contact 633B and a guiding element. The first moveable contact assembly 601A and the second moveable contact assembly 601B may each be similar or identical to the moveable contact assembly 300 described above in connection with FIG. 3. As depicted, the first moveable contact assembly 601A is operatively coupled to the at least one securing element 621. Similarly, it should be understood that the second moveable contact assembly 601B is operatively coupled to a securing element disposed adjacent thereto and associated therewith.

As noted above, and as depicted in FIG. 6, the first moveable contact assembly 601A comprises a first substrate 605 defining a substantially planar elliptical body. As shown, the first moveable moveable contact 603A and the second moveable moveable contact 603B are disposed on a first/top surface of the first substrate 605 (e.g., on a first side and a second side of the example first substrate 605). Additionally, as depicted, the first moveable contact assembly 601A comprises a guiding element 613 which may operate to facilitate movement of the moveable contact assembly 601A in conjunction with a securing element 621 and with respect to the moveable carrier 630. At least a portion of the the guiding element 613 may be in contact with a first/top surface and a second/bottom surface of the first substrate 605. Additionally, as illustrated, the guiding element 613 is disposed centrally (e.g., disposed between moveable contacts 603A and 603B of the moveable contact assembly 601A) with respect to the first substrate 605 of the moveable contact assembly 601 and surrounds at least a portion of the first substrate 605.

As depicted in FIG. 6, the moveable contact assembly 601 comprises a blade spring element 615 disposed adjacent a bottom surface of the substrate 605. The blade spring element 615 may operate to facilitate lateral and/or vertical movement of the moveable contact assembly 601, and in particular the first moveable moveable contact 603A and the second moveable moveable contact 603B disposed on a first/top surface of the first substrate 605. As depicted, the blade spring element 615 comprises a bridge-shaped element at least partially spaced apart from a second/bottom surface of the first substrate 605. As shown, at least a first end portion of the blade spring element 615 and at least a second portion of the blade spring element 615 may be fixedly attached or otherwise coupled to the second/bottom surface (e.g., a first side and a second side) of the first substrate 605. As further depicted, at least a portion of the blade spring element 615 is fixedly attached to or otherwise coupled to the guiding element 613 (e.g., via a securing pin).

As noted above, and as further depicted in FIG. 6, the switching component 600 comprises a moveable carrier 630 and at least a securing element 621. The securing element 621 and the moveable carrier 630 may define a unitary body or be otherwise fixedly attached to one another. As depicted, at least a a portion of the guiding element 613 is configured to engage and/or abut at least a portion of the securing element 621. For example, as illustrated, a first appendage 617 of the guiding element 613 is configured to engage an aperture (e.g., slots, grooves, or the like) of the securing element 621. As depicted, the first appendage 617 is configured to engage an rectangular aperture of the securing element 621 such that the moveable contact assembly can rotate (e.g., wobble, move and/or the like) about an axis of the first appendage 617. In various examples, movement of of the guiding element 613 in relation to the appendage 617 may be at least partially facilitated by elasticity of the blade spring element 615 disposed therebeneath which allows the blade spring element 615 to deform in response to movement of the moveable contact assembly 601A. In some examples, the blade spring element 615 may deform between 0.3 mm to 0.5 mm. In various examples, the first moveable contact 603A and the second moveable contact 603B of the moveable contact assembly are configured to move freely in an x-direction (e.g., laterally) and y-direction (e.g., up and down) with respect to the moveable carrier 630/securing element 621 such that the the first moveable contact 603A and the second moveable contact 603B can make contact with adjacent stationary contacts 623 in order to actuate an electrical bridge. Said differently, the moveable contact assembly 601 can move with two degrees of freedom in relation to the moveable carrier 630/securing element 621. By way of example, as depicted, the first moveable contact 603A is configured to make contact with the stationary contact 623 attached to the first bridge element 625. Similarly, each moveable contact of a respective moveable contact assembly may be configured to make contact with an adjacent stationary contact 623 that is fixedly attached to a respective bridge element adjacent thereto.

While some of the embodiments herein provide an example portion of a switching component 600, it is noted that the scope of the present disclosure is not limited to such embodiments. A switching component 600 in accordance with the present disclosure may comprise one or more additional and/or alternative elements, and/or may be structured/positioned differently than that illustrated in FIG. 6.

Using the apparatuses and techniques disclosed herein (e.g., by utilizing integrated moveable contact assemblies) the electrical service life of an example switching component can be greatly increased. The example switching component will function optimally when configured in any position within a system and will not be affected by gravity. By way of example, a switching component with integrated moveable contact assemblies may provide two degrees of freedom of movement may greatly increase reliability and longevity of the switching component. Additionally, by utilizing integrated moveable contact assemblies, motion of the integrated moveable contact assembly in relation to the stationary contacts will not be affected by any conceivable orientation of the switching component. Further, the example switching component of the present disclosure is less complex and inexpensive to produce in comparison to existing devices.

Many modifications and other embodiments of the present disclosure set forth herein will come to mind to one skilled in the art to which these embodiments pertain having the benefit of the teachings presented in the foregoing descriptions and the associated drawings. Therefore, it is to be understood that the disclosure are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

The invention claimed is:

1. A switching component comprising:

a housing;

a moveable carrier disposed within the housing;

at least one integrated moveable contact assembly, the moveable contact assembly comprising a substrate, a set of moveable contacts disposed on a first surface of the substrate and a guiding element surrounding at least a portion of the substrate, wherein each guiding element comprises at least one appendage configured to abut an aperture of a securing element associated with the moveable carrier; and a set of stationary contacts adjacent the set of moveable contacts, wherein the set of moveable contacts is configured to move with two degrees of freedom to make contact with the set of stationary contacts in order to actuate an electrical bridge in response to movement of the moveable carrier.

2. The switching component of claim 1, wherein the integrated moveable contact assembly is attached to the moveable carrier via the securing element.

3. The switching component of claim 1, wherein:

the set of stationary contacts comprises a first moveable contact and a second moveable contact, and the set of moveable contacts comprises a third moveable contact adjacent the first moveable contact and a fourth moveable contact adjacent the second moveable contact.

4. The switching component of claim 1, wherein the set of stationary contacts is fixedly attached to at least one bridge element of the switching component.

5. The switching component of claim 1, wherein the set of moveable contacts is configured to rotate about an axis, wherein each of the moveable contacts of the set of moveable contacts are configured to rotate in the same direction in unison.

6. The switching component of claim 1, wherein the at least one integrated moveable contact assembly further comprises a blade spring element disposed adjacent a second surface of the substrate configured to deform in response to movement of the integrated moveable contact assembly.

7. The switching component of claim 6, wherein the blade spring element comprises an arch, ladder or bridge shape.

8. The switching component of claim 6, wherein the substrate, the guiding element and the blade spring element are fixedly attached to one another via a securing pin.

9. The switching component of claim 6, wherein a first side of the blade spring element is fixedly attached to a first side of the substrate and a second side of the blade spring element is fixedly attached to a second side of the substrate defining a gap therebeneath.

10. The switching component of claim 9, wherein the set of moveable contacts is configured to rotate about an axis of the at least one appendage of the guiding element.

11. A switching component comprising:

a housing;

a moveable carrier disposed within the housing;

a first integrated moveable contact assembly, a second integrated moveable contact assembly, a third integrated moveable contact assembly and a fourth integrated moveable contact assembly, wherein each integrated moveable contact assembly comprises a substrate, a set of moveable contacts disposed on a first surface of the substrate and a guiding element surrounding at least a portion of the substrate, wherein each guiding element comprises at least one appendage configured to abut an aperture of a securing element associated with the moveable carrier; and a set of stationary contacts adjacent each respective set of moveable contacts of the first integrated moveable contact assembly, the second integrated moveable contact assembly, the third integrated moveable contact assembly and the fourth integrated moveable contact assembly, wherein each set of moveable contacts is configured to move with two degrees of freedom to make contact with a respective set of stationary contacts in order to actuate an electrical bridge in response to movement of the moveable carrier.

12. The switching component of claim 11, wherein each integrated moveable contact assembly is attached to the moveable carrier via the securing element associated therewith.

13. The switching component of claim 11, wherein:

each set of stationary contacts comprises a first moveable contact and a second moveable contact, and each set of moveable contacts comprises a third moveable contact adjacent the first moveable contact and a fourth moveable contact adjacent the second moveable contact.

14. The switching component of claim 11, wherein each set of stationary contacts is fixedly attached to at least one bridge element of the switching component.

15. The switching component of claim 11, wherein each integrated moveable contact assembly further comprises a blade spring element disposed adjacent a second surface of the substrate configured to deform in response to movement of the integrated moveable contact assembly associated therewith.

16. The switching component of claim 15, wherein each blade spring element comprises an arch, ladder or bridge shape.

17. The switching component of claim 15, wherein each substrate, guiding element and the blade spring element of each integrated moveable contact assembly is fixedly attached to one another via a securing pin.

18. The switching component of claim 15, wherein a first side of each blade spring element is fixedly attached to a first side of a substrate associated therewith and a second side of each blade spring element is fixedly attached to a second side of the substrate associated therewith defining a gap therebeneath.

19. The switching component of claim 18, wherein each guiding element comprises a first appendage configured to abut a first aperture of the securing element associated therewith and a second appendage configured to abut a second aperture of the securing element associated therewith.

* * * * *